United States Patent [19]

Kim

[11] Patent Number: 4,673,364

[45] Date of Patent: Jun. 16, 1987

[54] SWIMMING APPARATUS

[76] Inventor: Jeong R. Kim, 53 Sogeok-Dong Jongro-Ku, Seoul, Rep. of Korea

[21] Appl. No.: 893,655

[22] Filed: Aug. 6, 1986

[30] Foreign Application Priority Data

Aug. 9, 1985 [KR] Rep. of Korea ..... 10251/1985[U]

[51] Int. Cl.[4] ..... A63B 31/12

[52] U.S. Cl. ..... 441/59

[58] Field of Search ..... 441/55, 56, 58, 59, 441/122; 440/21

[56] References Cited

U.S. PATENT DOCUMENTS

| | | | |
|---|---|---|---|
| 760,881 | 5/1904 | Lawson | 441/59 |
| 805,526 | 11/1905 | Bullock | 441/56 |
| 1,708,331 | 4/1929 | Ryan | 441/58 |
| 1,911,129 | 5/1933 | Ederle et al. | 441/56 |

FOREIGN PATENT DOCUMENTS

| | | | |
|---|---|---|---|
| 714005 | 9/1943 | Fed. Rep. of Germany | 441/56 |
| 28657 | of 1907 | United Kingdom | 441/56 |

*Primary Examiner*—Joseph F. Peters, Jr.
*Assistant Examiner*—Jesûs D. Sotelo
*Attorney, Agent, or Firm*—Lockwood Alex Fitzgibbon & Cummings

[57] ABSTRACT

A swimming apparatus consisting of a generally cylindrical main body which is hollow and in which the front portion and rear portion are constructed and positioned in a streamlined fashion. The interior of the hollow, generally cylindrical main body is divided into a plurality of water-tight air chambers by a plurality of partition walls integrally fixed to the interior sides of said body. A diamond shaped face plate is affixed to the front underside portion of said body and extends outwardly therefrom. Attached by a hinge to the face plate is a pivotally mounted flange. The back and forth movement of the flange is somewhat restricted by wedge-shaped movement restricting members mounted on the underside of the face plate in front of the pivotally mounted flange and by wedge-shaped space maintaining members affixed to the back side of the pivotally mounted flange itself.

A wall extends downwardly from both sides of the generally cylindrical body behind the face plate. In the space between said walls and affixed to them perpendicularly is a handle to be grasped by the user and behind said handle is an arm supporting strap affixed perpendicularly to said walls.

1 Claim, 8 Drawing Figures

SWIMMING APPARATUS

BACKGROUND OF THE INVENTION

This invention relates to a swimming apparatus that makes it possible for unskilled and non-swimmers to enjoy the benefits of swimming. Even accomplished swimmers can use the described apparatus to their advantage because it will allow them to vary and supplement the exercise obtained through swimming.

Swimming, of course, is the action by which one propels oneself in water through the coordinated movement of the arms and the legs. Existing flotation devices such as kick-boards, tube-type, and mattress-type structures, may facilitate and even encourage leg movements in the water, but as yet, no effective apparatus has been developed that supports the user in the water while at the same time allowing the user to propel himself using both arms and legs together to enjoy the pleasure of unrestricted swimming. The present device accomplishes this and also provides a safe flotation method that can be used by those beginning to learn how to swim, those undergoing certain forms of physical therapy, and others lacking sufficient body strength to remain afloat without assistance. Further, because the arm motion required in using the present invention is different from that used in conventional swimming, a person who does know how to swim can use the described apparatus to exercise muscle groups that are not exercised or that are exercised in a different way during normal swimming.

SUMMARY OF THE INVENTION

The present invention is a flotation apparatus that allows people of all ages to enjoy swimming by giving them free and unrestricted use of their arms and legs to propel themselves under their own power in the water. In its basic configuration, the swimming apparatus consists of a generally cylindrical main body that is hollow and in which the interior of said generally cylindrical main body is divided into a plurality of water tight chambers by partition walls spaced within the interior of the hollow, generally cylindrical main body.

A face plate is attached toward the front and on the underside of the generally cylindrical main body. A flange is pivotally mounted by means of a hinge or hinges on the underside of the face plate. At rest, the pivotally mounted flange extends downward perpendicularly from said face plate.

A hand grip is situated behind the end of the face plate and is mounted between two walls that descend downward from the generally cylindrical main body. Behind the hand grip is a strap through which the user inserts his arm before grasping the hand grip situated ahead of the strap. After the user has properly positioned the apparatus and has positioned his arm within the apparatus, he employs the apparatus by pushing it in front of him and horizontally along the surface of the water. Water resistance against the front side of the pivotally mounted flange causes it to fold under the generally cylindrical main body and substantially parallel to the face plate. Thereafter, as the user pulls the apparatus back toward and alongside his body, the pivotally mounted flange is forced forward by water resistance against its rear face until it is once again perpendicular to the surface of the water and to the face plate. The movement of the pivotally mounted flange is restricted so that it can swing forward only to such point that it is substantially perpendicular to the face plate and the surface of the water. Thus, as the user continues to pull the apparatus after the pivotally mounted flange has resumed a position perpendicular to the face plate, the water resistance against the rear face of the pivotally mounted flange will cause the user to be propelled forward in the water.

By pushing and pulling the apparatus attached to each of the user's arms in a cycle whereby one arm pushes forward while the other draws back, the user will be able to enjoy moving in the water under his own power as in swimming.

The exact manner in which the invention is carried into practice will become more clearly apparent when reference is made to the following detailed description of the preferred embodiments of the invention set forth by way of example, and shown in the accompanying drawings, wherein like reference numbers indicate corresponding parts throughout.

DESCRIPTION OF PREFERRED EMBODIMENTS OF THE INVENTION

Figure 2:
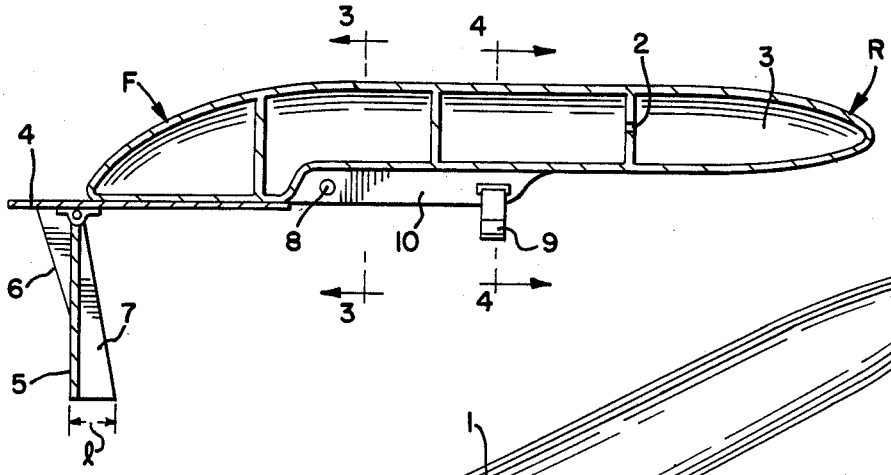
FIG. 2 is a cross-sectional side view of the swimming apparatus in accordance with this invention.
Figure 1:
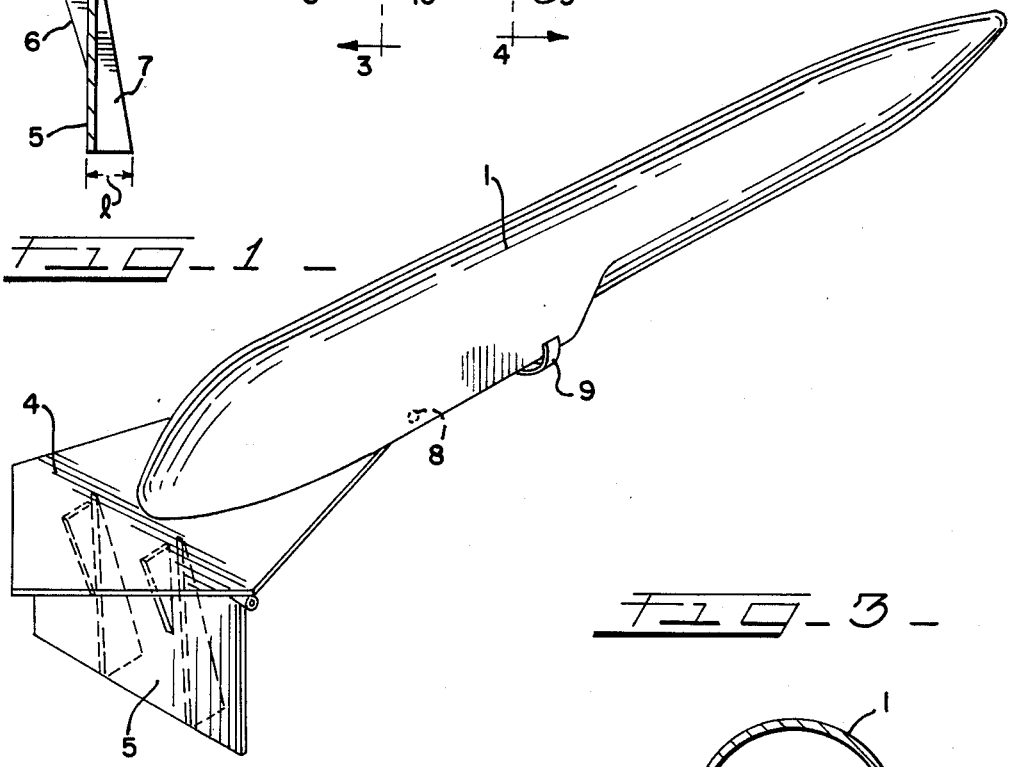
FIG. 1 is a perspective view of the swimming apparatus in accordance with this invention.
Figure 3:
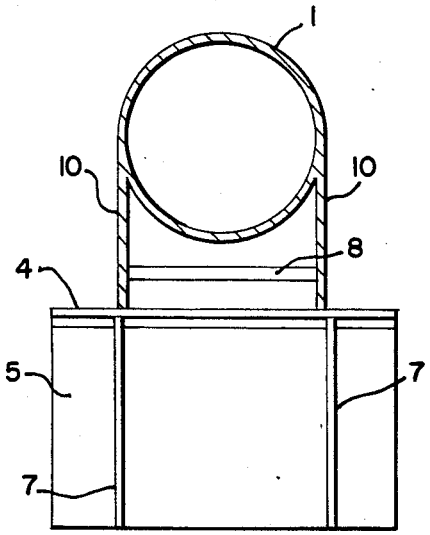
FIG. 3 is a cross-sectional view of the present invention, taken along line 3—3 of FIG. 2.
Figure 4:
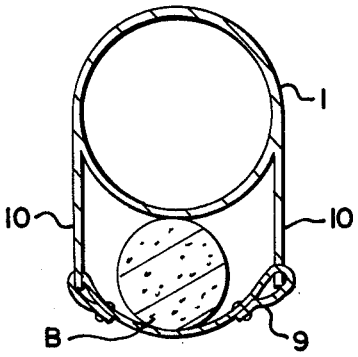
FIG. 4 is a cross-sectional view of the present invention, taken along line 4—4 of FIG. 2.

The swimming apparatus of this invention includes a generally cylindrical main body 1 in which the front portion F and rear portion R are constructed and arranged in a streamlined configuration. The hollow interior of cylindrical body 1 is divided by a plurality of partition walls 2 that are fixed to the interior sides of the main body 1 in predetermined positions to form a plurality of water-tight air chambers 3.

A face plate 4 is generally diamond shaped and is affixed to the front portion of the underside of the main body 1 and extends outwardly from the streamlined front portion of the main body 1. A pivotally mounted flange 5 is hingedly connected to the underside of the face plate 4. Free back and forth movement of the flange 5 is restricted by wedge-shaped movement restricting members 6 affixed to the underside of the face plate 4 and by wedge-shaped space maintaining members 7 affixed to the back side of the flange 5.

Thus, when the swimming apparatus is pulled forward alongside the user, the flange 5 will be forced by water resistance against its back side to swing into a position perpendicular to the face plate 4 at which point further movement of the flange 5 will be prevented by the restraining members 6. When the swimming apparatus is pushed forward in the water by the user, the flange 5 will be forced by water resistance to swing up under the apparatus until its movement is arrested by contact between the wedge-shaped members 7 and the face plate 4.

The main body 1 also includes an assembly adapted to receive and support the arm of the user of the device. A pair of parallel walls 10 extend downwardly from the body 1. A handle 8 is affixed between the walls 10 in a perpendicular relation to the walls 10. Behind the handle 8, there is positioned an arm strap 9 which is attached through the walls 10. The strap 9 is generally parallel to the handle 8 and lies in a plane perpendicular to the walls 10.

Using one swimming apparatus for each arm, the user inserts his arm between walls 10 and over the arm strap 9 and extends his arm forward until he can grasp the handle 8.

Upon entering the water, where he will be kept afloat by the buoyancy of the body 1, the user positions his body for swimming. By alternatively pushing and pulling his arms in front and alongside of himself while firmly grasping handles 8, the user will cause the flanges on each apparatus to move in the manner indicated above. By cooperatively alternating the pushing and pulling action between each arm in a continuous cycle, the user will propel himself in the water in a manner approximating swimming.

Figure 7:
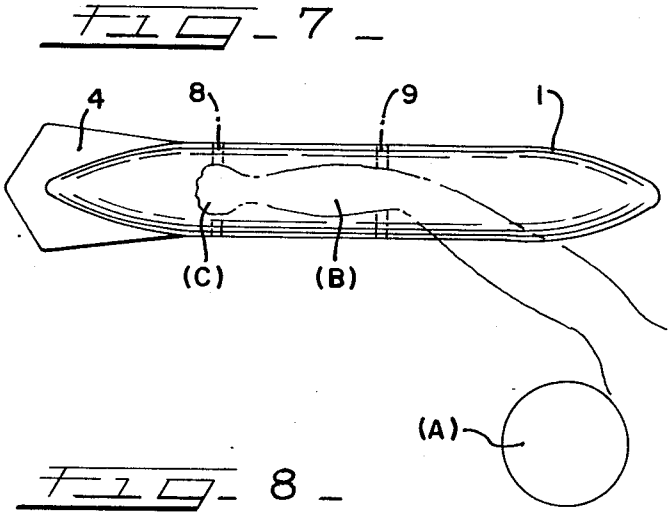
FIG. 7 is a top plan view showing the apparatus of the present invention thrust forward by a swimmer.
Figure 8:
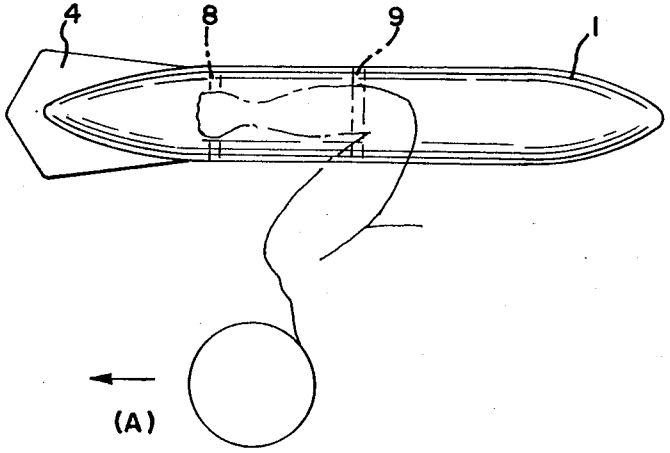
FIG. 8 is a top plan view showing the swimming apparatus of the present invention in a pulled-back position alongside the swimmer.
Figure 5:
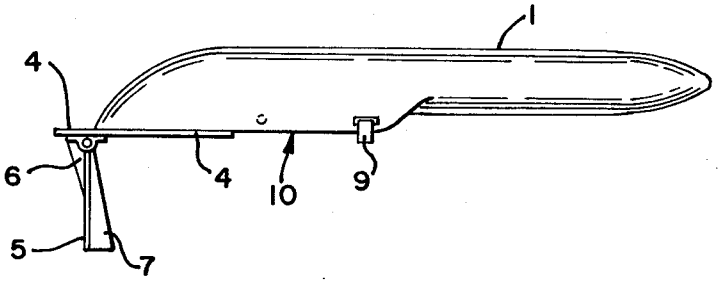
FIG. 5 is a side view of the present invention showing the pivotally mounted flange in its fully extended position perpendicular to the face plate.
Figure 6:
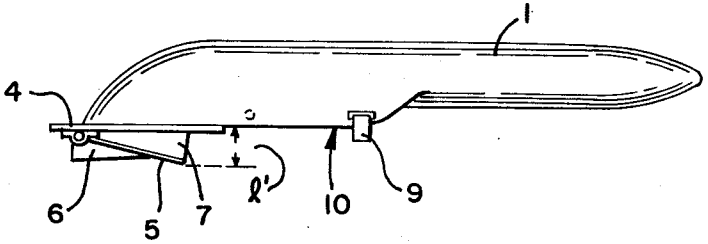
FIG. 6 is a side view of the present invention showing the pivotally mounted flange in its folded position.

As the user pushes one arm forward while firmly grasping the handle 8, the flange 5, hinged to the face plate 4, folds under face plate 4 to a position substantially parallel to the face plate 4. This allows the apparatus to move forward due to the decreased water resistance. This operation is depicted in FIG. 6 and FIG. 7.

After the user has thrust the apparatus forward in the manner described above, and illustrated in FIG. 7, he pulls the apparatus back toward himself and alongside his body whereupon the flange 5 is forced by water resistance to swing forward until it comes to rest against the members 6 affixed to the underside of the face plate 4. At this point, the flange 5 is perpendicular to the face plate 4. Thus, as the user continues to draw the apparatus towards himself and alongside his body, the downwardly extended flange 5 encounters significant water resistance and the user will be propelled forward.

Simultaneously with the above described action, the user moves his other arm, which is inserted in another swimming apparatus, in the opposite direction. Through the repetition of the aforedescribed cycle of movements, the user will propel himself in the water utilizing the buoyancy of the apparatus as well as the water resistance against the flange 5 in its fully extended position perpendicular to the face plate.

While the invention has been described with reference to its preferred embodiment, it will be understood by those skilled in the art that various changes may be made and equivalents may be substituted for the elements thereof without departing from the spirit of the invention or the scope of the appended claim. In addition, modifications to the specifics will occur to those skilled in the art. Therefore, it is intended that the invention not be limited to the particular embodiment disclosed as the best mode contemplated for carrying out this invention, but that the invention will include all embodiments falling within the scope of the appended claim.

What I claim is:

1. A swimming apparatus comprising a generally cylindrical main body, having a plurality of internal chambers and a plurality of partition walls for maintaining the buoyancy of the apparatus, said partition walls being integrally positioned within the internal chamber of said body, a planar face plate attached to said body and positioned at the front lower portion of said body, a flange hingedly attached to the underside of said face plate, first wedge-shaped members affixed to said face plate and positioned in front of said pivotally mounted flange and second wedge-shaped members attached to the rear face of said pivotally mounted flange, said members restrict and control the movement of said flange with respect to said body and said faceplate, and an arm retaining assembly for supporting the arm of a person using the apparatus, said arm retaining assembly including a plurality of walls downwardly extending from said body, a handle and an arm strap, said handle and said arm strap are positioned between said walls.

* * * * *